US005743124A

United States Patent [19]

Sugiyama et al.

[11] Patent Number: 5,743,124

[45] Date of Patent: Apr. 28, 1998

[54] METHOD OF BENDING EXTRUDED SHAPES

[75] Inventors: Keiichi Sugiyama, Tokyo; Mitsuo Tsuge; Tadashi Hakamada, both of Ihara-gun; Masayoshi Ohhashi; Kunihiro Yasunaga, both of Saitama, all of Japan

[73] Assignees: Nippon Light Metal Co.; Honda Giken KKK, both of Tokyo, Japan

[21] Appl. No.: 747,703

[22] Filed: Nov. 12, 1996

[30] Foreign Application Priority Data

Nov. 16, 1995 [JP] Japan ..... 7-298143

[51] Int. Cl.[6] ..... B21D 5/06

[52] U.S. Cl. ..... 72/166; 72/256; 72/702

[58] Field of Search ..... 72/166, 256, 257, 72/702, 7.1, 7.2

[56] References Cited

U.S. PATENT DOCUMENTS

| | | | |
|---|---|---|---|
| 4,989,439 | 2/1991 | Ewert | 72/702 |
| 5,321,967 | 6/1994 | Wakabayashi | 72/260 |

FOREIGN PATENT DOCUMENTS

| | | | |
|---|---|---|---|
| 1383768 | 11/1964 | France | 72/256 |
| 25217 | 2/1982 | Japan | 72/256 |
| 238348 | 8/1994 | Japan | 72/166 |

*Primary Examiner*—Daniel C. Crane

*Attorney, Agent, or Firm*—Longacre & White

[57] ABSTRACT

A method of bending extruded shapes of the present invention controls a bending radius and a bending angle in accordance with a moving distance of a movable bending die. In the bending process, hardness of an extruded shape to be processed is measured and converted into proof stress, and the bending condition for compensating the springback is determined. A correction coefficient C showing a ratio of a practical value of the moving distance and a theoretical value of the moving distance in a case of no spring-back occurring is defined by a function of Young's modulus E, geometrical coefficient Z, bending radius R and proof stress $\sigma_{0.2}$ for the extruded shape to be processed. The correction coefficient C is obtained by measuring the hardness of the extruded shape to be processed, converting the measured hardness into the proof stress, and substituting the proof stress and a predetermined bending radius R into the function, and the practical value of the moving distance of the movable bending die is determined.

4 Claims, 6 Drawing Sheets

METHOD OF BENDING EXTRUDED SHAPES

BACKGROUND OF THE INVENTION

1. Field of the Invention

The present invention relates to a method of bending metal extruded shapes such as aluminum alloy, utilized for automobile frames and architectural members such as sash, and more particularly relates to a method of bending extruded shapes in which springback generating on a work when it is removed from an apparatus is taken into consideration, and in which a correction value for compensating springback is calculated from pre-measured hardness of material.

2. Prior Art

There are several kinds of methods of bending extruded shapes to a bending moment to extruded shapes, e.g., tubing or profiles. One method is die bending, a middle portion of an extruded shape held by two supporting dies is pressed using a moveable bending die of finishing machines. Another method is extrusion bending shown in FIG. 1, where a bending-processed work 3 is obtained by holding the extruded shape from a fixing die 1 with a movable bending die 2 which is arranged so as to move horizontally, vertically and rotatably, and moving the movable bending die 2 to process the two or three dimentional bending to attain a predetermined bending radius R with the moving distance M of the movable bending die 2.

However, after the bending is proceeded, when weight is applied to the movable bending die 2 is removed from the bending-processed work 3, its radius is returned. Accordingly, transformation which is called springback occurs.

The springback occurring in bending radius R or bending angle θ is, in general, effected by a bending moment M and flexural rigidity E×I of a work to be processed, which is calculated from one of the following equations (1) or (2). In particular, in a case of materials having small Young's modulus compared to iron, e.g., aluminum alloy, since the flexural rigidity EI is small, the springback becomes large in the bending process, which is a serious problem of bending process.

$$\frac{1}{R_1} - \frac{1}{R_2} = \frac{M}{E \times I} \tag{1}$$

or $$\Delta\theta = \theta_1 - \theta_2 = \frac{M \times R_1 \times \theta_1}{E \times I} \tag{2}$$

Here $R_1$, $\theta_1$: bending radius and bending angle with loading $R_2$, $\theta_2$: bending radius and bending angle with unloading M : bending moment E : Young's modulus I : geometrical moment of inertia (E×I : Flexural rigidity)

Therefore, in general, prior to the bending process, a bending mold is produced allowing for such springback, and the moving distance of the movable bending die for controlling the bending radius or the bending angle is set larger. However, since the springback varies with loading methods and the bending condition, it is hard to predict the required bending radius or bending angle accurately, allowing for the springback. In practice, the bending is proceeded by correcting the bending moment, e.g., caused by the moving distance of the movable bending die through trial and error. Accordingly, in the case of second or third dimentional bending with the above-described extrusion bending method, it is hard to control the bending moment.

SUMMARY OF THE INVENTION

It is an object of the present invention to provide a method of bending extruded shapes which can efficiently attain desired bending radius and bending angle by correcting bending moment. Further, it is another object of the present invention to provide a method of bending extruded shapes by determining factors which control the springback and which are easily measured, controlling bending moment based on measured values of the factor to control the bending radius and the bending angle.

In order to achieve the above objects, a method of bending extruded shapes of the present invention for controlling a bending radius and a bending angle in accordance with a moving distance comprises steps of 1) measuring the hardness of an extruded shape to be processed, 2) converting the measured hardness into proof stress, 3) determining the bending condition for compensating spring-back based on the proof stress, and 4) performing bending procedures.

Here, a correction coefficient C showing a ratio of a practical value of the moving distance and a theoretical value of the moving distance in a case of no spring-back occurring can be defined by a function of Young's modulus E, geometrical coefficient Z, bending radius R and proof stress a $\sigma_{0.2}$ for the extruded shape to be prossed. Next, the correction coefficient C can be obtained by measuring the hardness of the extruded shape to be processed, converting the measured hardness into the proof stress, and substituting the proof stress and a predetermined bending radius R into the function, and then the practical value of the moving distance of the movable bending die is determined.

When bending is performed by pushing an aluminum alloy extruded shape into a fixing die and a movable bending die, the hardness H of the extruded shape to be measured can be measured and converted into a 0.2% proof stress $\sigma_{0.2}$ by a first equation of $$\sigma_{0.2} = g \times H + h$$

here g, h: constant.

Next, a correction coefficient C showing a ratio of a practical value of the moving distance and a theoretical value of the moving distance is calculated from a second equation of $$C = \{A \times (Z \times \sigma_{0.2}) + 0.3\} \times 10^{-3} \times R \times B$$

Here

A: constant in the range of $(8-10) \times 10^{-6}$

B: constant in the range of 3.0–3.6

Z: average value of moduli of section on the tension side and compression side ($mm^3$)

$\sigma_{0.2}$: 0.2% proof stress in the tension test ($kgf/mm^2$)

R: bending radius (mm) .

Then, the practical value of the moving distance of the movable bending die is determined.

Here, in a case that the extruded shape to be processed is aluminum alloy extruded shapes of JIS A6063 (regulated in Japanese Industrial Standards), when the first equation is used for determining 0.2% proof stress (kgf/mm$^2$) from Rockwell F scale hardness, preferably g=0.30 and h=−1.63.

According to the present invention, in the bending, the springback is taken into consideration, and the strength of a material which is a large factor affecting the result of bending is converted from the hardness that is measured easily and this strength is used as bending data. Accordingly, the moving distance of the movable bending die for compensating the springback can be found efficiently and easily.

Further, in the extrusion bending, the formula of the Rockwell hardness and proof stress is combined with the formula of proof stress, geometrical coefficient and bending radius, and prior to the bending process, materials to be processed are pre-tested, so that the appropriate moving distance of the movable bending die for compensating springback of aluminum alloy can be found, which is very effective in practice.

Furthermore, since JIS A6063 which is frequently utilized is used as an aluminum alloy extruded shape, bending can easily and efficiently be performed.

PREFERRED EMBODIMENTS OF THE INVENTION

Figure 1:
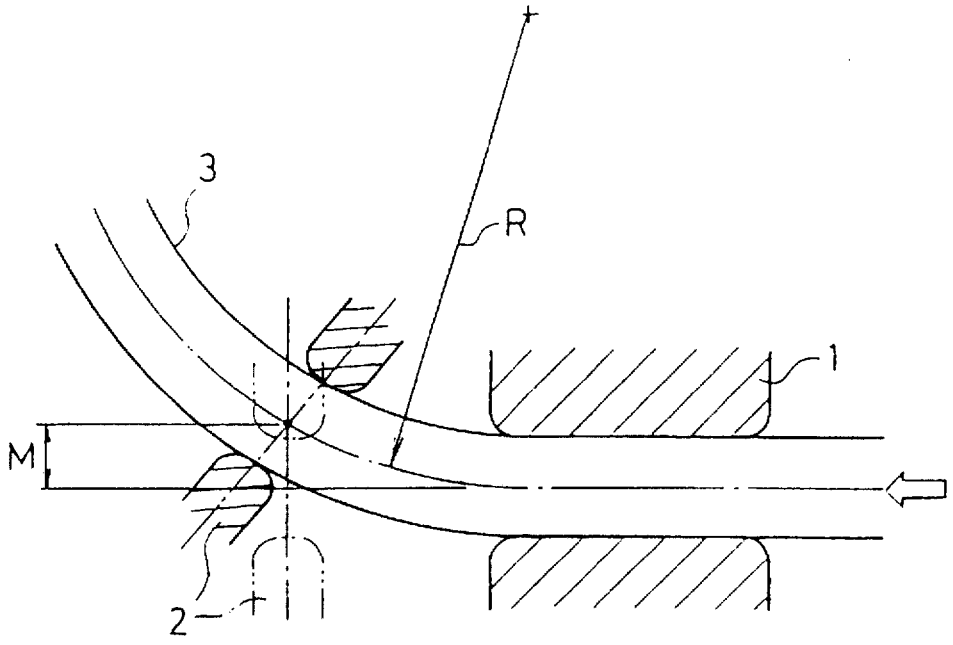
FIG. 1 is a schematic view showing a finishing machine for extrusion bending utilizing a movable bending die.

The preferred embodiments of the present invention will be described in detail with reference to the drawings hereinafter. In the description, the same reference numerals are used for the same components and repetitive description on the same components is omitted.

The springback in the bending process is calculated by the aforementioned equation (1) or (2). However, the required bending moment for bending a work to a predetermined bending radius R depends on the hardness of the work to be processed. Assuming that the hardness of the work to be processed is expressed by 0.2% proof stress $\sigma_{0.2}$ which is an elastic limit, the springback S can also be expressed by a function of E, Z, $\sigma_{0.2}$ and R.

$$S=f_1(E, Z, \sigma_{0.2}, R) \quad (3)$$

Here

Z: modulus of section

If extruded shapes having the same material and quality are utilized as works to be processed, Young's modulus is constant, and Modulus of section Z is an average value of moduli of section on the tension side and compression side and determined on the basis of the shape of the works to be processed. In the case of extrusion molding, although the modulus of section Z varies with the changes of shape of the extruding die due to wear of the extruding die gradually improving, the variation of the modulus of section Z is only 5% when the thickness of material is increased 5%, e.g., a material having the dimension of 50 mm×50 mm×2 mm increased to 50.2 mm×50.2 mm×2.1 mm. Accordingly, the size of the material to be processed, e.g., thickness is varied fine, so that it is sufficiently possible to correct the bending data without decreasing the work efficiency by occasionally measuring the size of the extruding die.

Regarding the hardness of the work to be processed, 0.2% proof stress of aluminum alloy extruded shapes of A6063-T1 and 6063-T5 which are regulated in Japanese Industrial Standards (JIS) will be considered. In JIS, the 0.2% proof stress of aluminum alloy extruded shapes of A6063-T1 and 6063-T5 are regulated to 6.0 kgf/mm$^2$ or above and 11 kgf/mm$^2$ or above, respectively. However, in practice, the measured values of the 0.2% proof stress of aluminum alloy extruded shapes of A6063-T1 and 6063-T5 are 7.0–8.7 kgf/mm$^2$ and 17–21 kgf/mm$^2$ depending on the materials of the extruded shapes and the measured position, respectively. It is realized that the measured values disperse 20% or more and that the 0.2% proof stress is effected by the dispersion of the springback, i.e., dispersion of bending shape. Accordingly, the accuracy of the bending process is enhanced by taking 0.2% proof stress into the bending data as the hardness of the work to be processed which relates to the bending moment.

The invention of controlling the moving distance of the movable bending die for holding an extruded shape with the proof stress in the case of extrusion bending is disclosed in Japanese Patent Application No. 7-184793 by some of the inventors of the present application.

However, in the case of the extruded shapes, proof stress varies depending on the materials of the extruded shapes as described above. For example, although the bending is processed by determining the springback simply from the average value of proof stress and compensating the springback, the bending radius or bending angle of the bending processed work still disperses. Further, in the bending process, to obtain a specimen to measure the strength, such as proof stress, may lower the work efficiency.

A method of bending an extruded shape of the present invention is to improve the bending accuracy without degrading the work efficiency by utilizing the hardness having small dispersion and the relative relationship with the strength of material, measuring the hardness of the work to be processed prior to the bending process, taking the measured value into the bending data, obtaining the practical moving distance of the movable bending die during the bending process on the basis of the relative relationship of the springback.

Let the ratio of the theoretical moving distance $M_r$ of the movable bending die, which is a case of no springback occurring, to practical moving distance $M_a$ thereof which is a case of springback occurring, be a correction coefficient C. Then, C is expressed by $$C=\frac{M_a}{M_r} \quad (4)$$

The correction coefficient C may be expressed by a function (5) of Young's modulus E, modulus of section Z, 0.2% proof stress $\sigma_{0.2}$, and bending radius R, of a work to be processed.

$$C=f_2(E, Z, \sigma_{0.2}, R) \quad (5)$$

Figure 2:
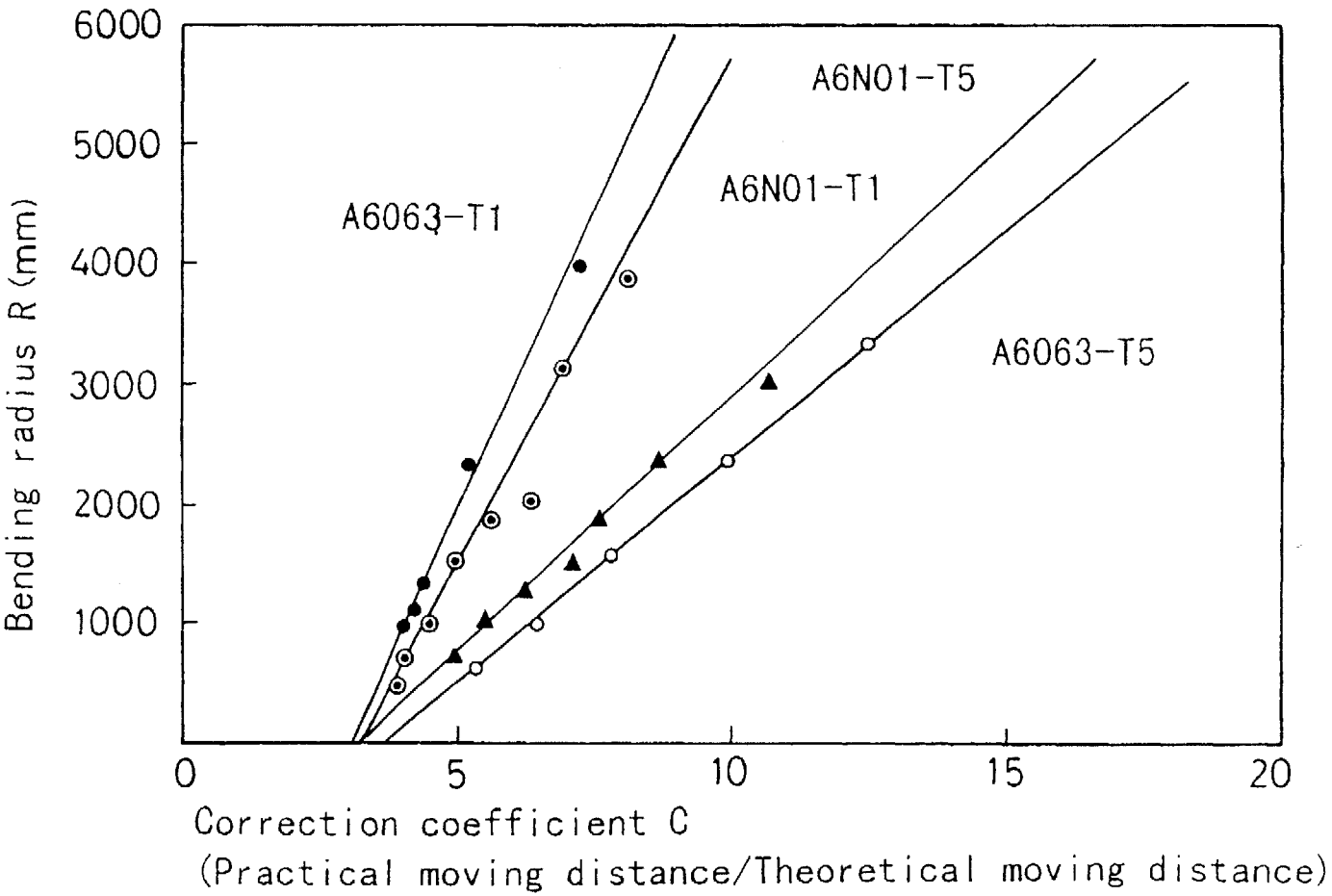
FIG. 2 is a graph showing the relationship between correction coefficient and bending radius in the bending process of an aluminum alloy extruded shape.

In the case of extrusion bending utilizing the fixing die and the movable bending die as shown in FIG. 1, it has been found that the correction coefficient C is substantially proportional to the bending radius R for the materials of A6063 and A6N01 (regulated in JIS) as shown in FIG. 2. Then, C can be expressed by $$C=a\,R+b \tag{6}$$

Figure 3:
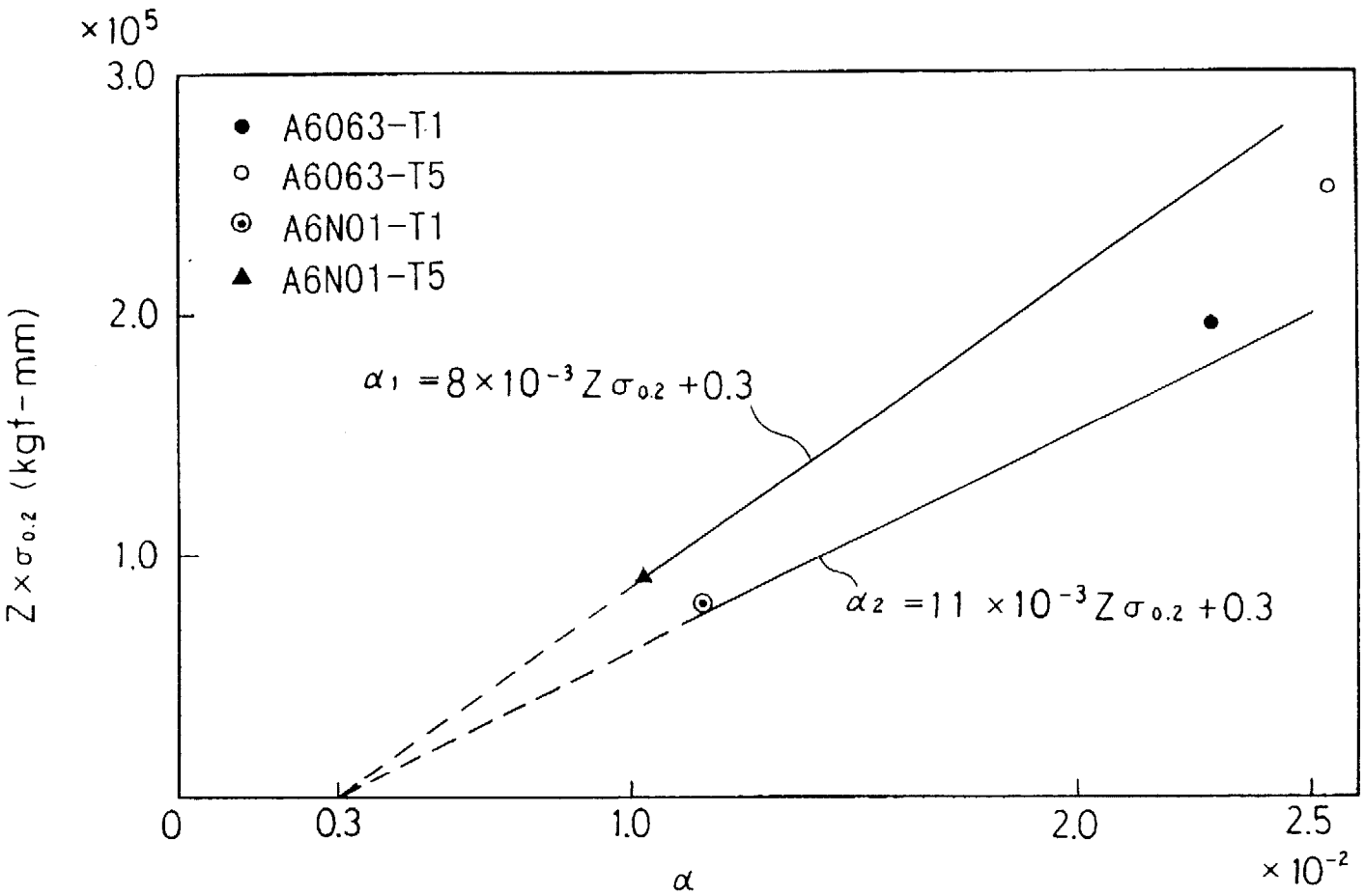
FIG. 3 is a graph showing the relationship between a constant and $Z\times\sigma_{0.2}$.

Constant a and an intersection b in equation (6) differ depending on works to be processed. However, it has been also found that Constant a is substantially proportional to the product of proof stress $\sigma_{0.2}$ and modulus of section Z, as shown in FIG. 3, which is expressed by $$a=d\times(E\times Z\times\sigma_{0.2})+e \tag{7}$$

Figure 6:
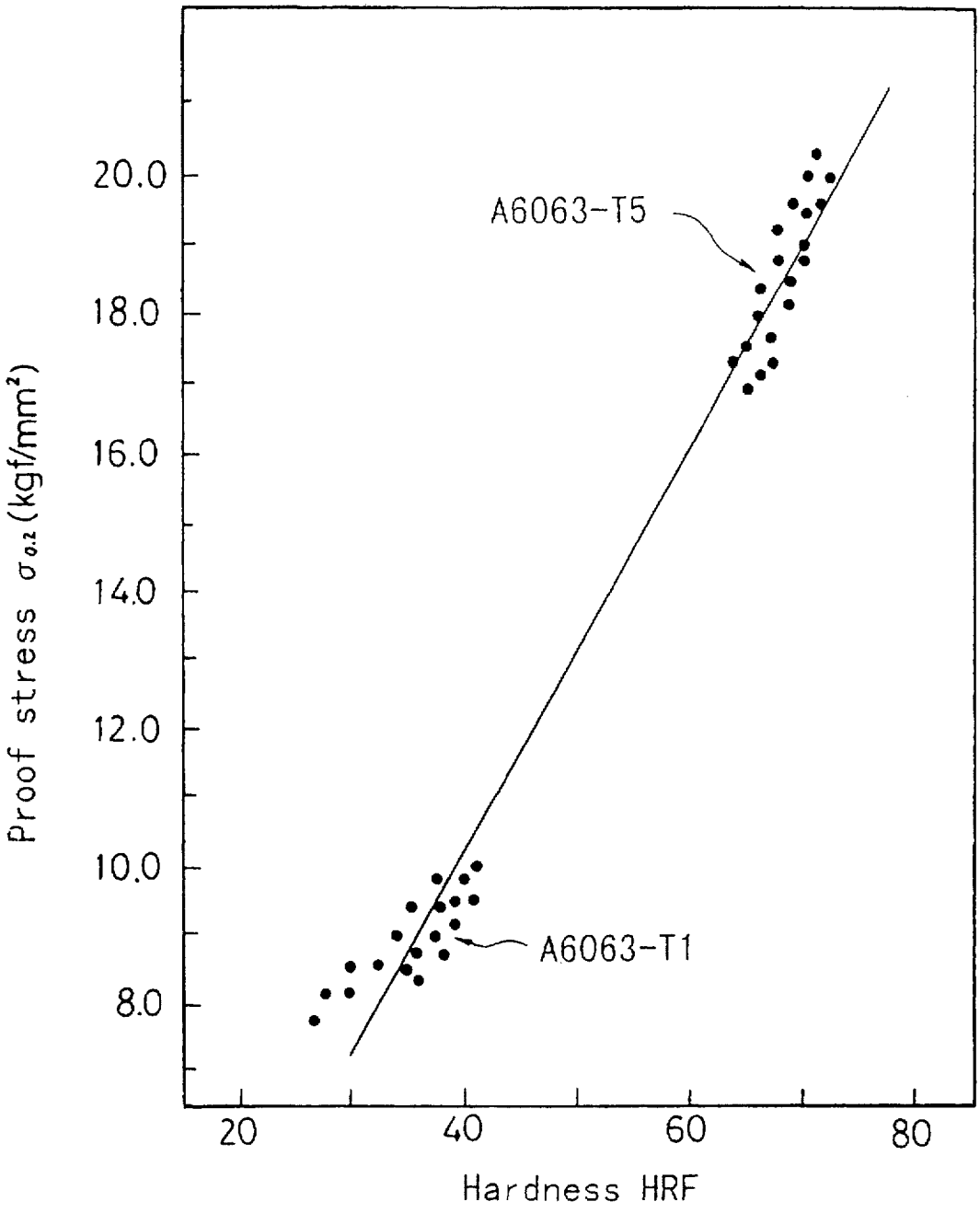
FIG. 6 is a graph showing the relationship between Rockwell hardness and proof stress in a case of a material of A6063.

Proof stress $\sigma_{0.2}$ is proportional to the hardness H as shown in FIG. 6, which is expressed by the equation (8)

$$\sigma_{0.2}=g\,H+h \tag{8}$$

Accordingly, $\sigma_{0.2}$ is substituted into the equations (7) and (6), and then it is expressed by the following equation.

$$C=[d\times\{E\times Z\times(g\,H+h)\}+e]R+b \tag{9}$$

Prior to the bending process, the relationship between the bending radius R and the correction coefficient C, which is expressed by the ratio of theoretical moving distance $M_t$ and practical moving distance $M_a$, is determined to obtain constants a and b in the equation (6). Next, constants d and e in the equation (7) are determined from the relationship between the obtained constant a and $E\times Z\times\sigma_{0.2}$, and constants g and h in the equation (8) are determined from the relationship between the proof stress $\sigma_{0.2}$ and the hardness H. Then, in the bending process, the correction coefficient C is determined by measuring the hardness H of the work to be processed, substituting the hardness H, bending radius R, constant g and constant H into the equation (9). Accordingly, the practical moving distance $M_a$ can be determined from the theoretical moving distance $M_t$.

It should be noted that constants d and e in the equation (7) can be obtained from the relationship to $Z\times\sigma_{0.2}$ if the materials of the works to be processed are the same, and that constants d and e can be obtained from the relationship to a and $\sigma_{0.2}$ if the works to be processed comprise the same material and the same sectional shape.

In the case of the aluminum alloy extruded shapes having A6063 and A6N01 (regulated in JIS), as described above, the relationship between the correction coefficient $C(=M_a/M_t)$ and the bending radius R, which is equivalent to the equation (6) shows the proportional relationship as shown in FIG. 2. Further, the relationship between the constant a and $Z\times\sigma_{0.2}$, which is equivalent to the equation (7), also shows the proportional relationship as shown in FIG. 3. Then, it has been found that α is within the range between $\alpha_1=8\times10^{-9}\times Z\sigma_{0.2}+0.3$ and $\alpha_2=11\times10^{-9}\times Z\sigma_{0.2}+0.3$ (Japanese Patent Application No. 7-184793).

Accordingly, the correction coefficient C is expressed by the following equation.

$$C=\{A\times(Z\times\sigma_{0.2})+0.3\}\times10^{-3}\times R\times B \tag{10}$$

Here

A: constant in the range of $(8-10)\times10^{-6}$

B: constant in the range of 3.0–3.6

Z: average value of moduli of section on the tension side and compression side ($mm^3$)

$\sigma_{0.2}$: 0.2% proof stress in the tension test ($kgf/mm^2$)

R: bending radius (mm)

Further, in the bending process of aluminum alloy extruded shapes, prior to the bending, the hardness of the work to be processed is measured, and the measured value is converted into 0.2% proof stress $\sigma_{0.2}$ with the conversion equation prepared based on the pre-measured values. Next, the $\sigma_{0.2}$ and the desired bending radius R are substituted into the equation (10) to obtain the correction coefficient C. Then, the practical moving distance of the movable bending die can be determined. Accordingly, the bending processed works have low dispersion in springback.

It should be noted that in the bending process other than the above-described extrusion bending, the above-stated equation (5) can also be set, so that similar to the extrusion bending, the concrete equation such as the above equation (9) and coefficients are determined.

Next, a case that the present invention is applied to JIS A6063 utilizing an extrusion bending apparatus shown in FIG. 1 for controlling the bending radius by controlling the moving distance of the movable bending die will be explained.

Ten samples of A6063-T1 having dimension of 50 mm×50 mm×2 mm and 0.2% proof stress of typical value of 7.5 $kgf/mm^2$(74$N/mm^2$) are utilized as works to be processed. The desired value of bending radius is R=490 mm. The above-stated equation (10) is utilized for the correction coefficient C. Proof stress $\sigma_{0.2}$=7.5 $kgf/mm^2$ and $A=9.5\times10^{-6}$, B=3.3 are used to obtain the correction coefficient C. Then, the bending is proceeded. The result of the bending radius is shown as white circles in FIG. 4 of graph showing the relationship between the proof stress $\sigma_{0.2}$ and the radius R. As apparent from FIG. 4, the obtained bending radius disperses in the range of 486 mm–498 mm.

Further, ten samples of A6063-T5 having 50 mm×50 mm×2 mm and 18.6 $kgf/mm^2$(182$N/mm^2$) typical value of 0.2% proof stress are utilized as materials to be processed. The desired value of bending radius is R=550 mm. The above-stated equation (10) is utilized for the correction coefficient C. Proof stress $\sigma_{0.2}$=18.6 $kgf/mm^2$ and $A=9.5\times10^{-6}$, B=3.3 are used to obtain the correction coefficient C. Then, the bending is proceeded. The result of the bending radius is shown as white circles in FIG. 5 of graph showing the relationship between the proof stress $\sigma_{0.2}$ and the radius R. As apparent from FIG. 5, the obtained bending radius disperses in the range of 535 mm–562 mm.

The relationship between Rockwell hardness HRF and 0.2% proof stress $\sigma_{0.2}$($kgf/mm^2$) is examined using samples of A-6063-T1 and A6063-T5. There is the relationship shown in FIG. 6 which is expressed by $$\sigma_{0.2}=0.30\times HRF-1.63 \tag{8a}$$

Using the equation (8a) as the conversion equation, 0.2% proof stress $\sigma_{0.2}$ is calculated, and using the equation (10), the correction coefficient C is obtained. From these values, the bending radius R is corrected. Then, the above ten samples for each A6063-T1 and A6063-T5 were proceeded to the bending process to obtain the desired bending radius R of 490 mm and 550 mm. The results are shown in FIG. 4 and FIG. 5 with black circles which shows the relationship between the proof stress $\sigma_{0.2}$ and the bending radius R when Z is constant.

Figure 4:
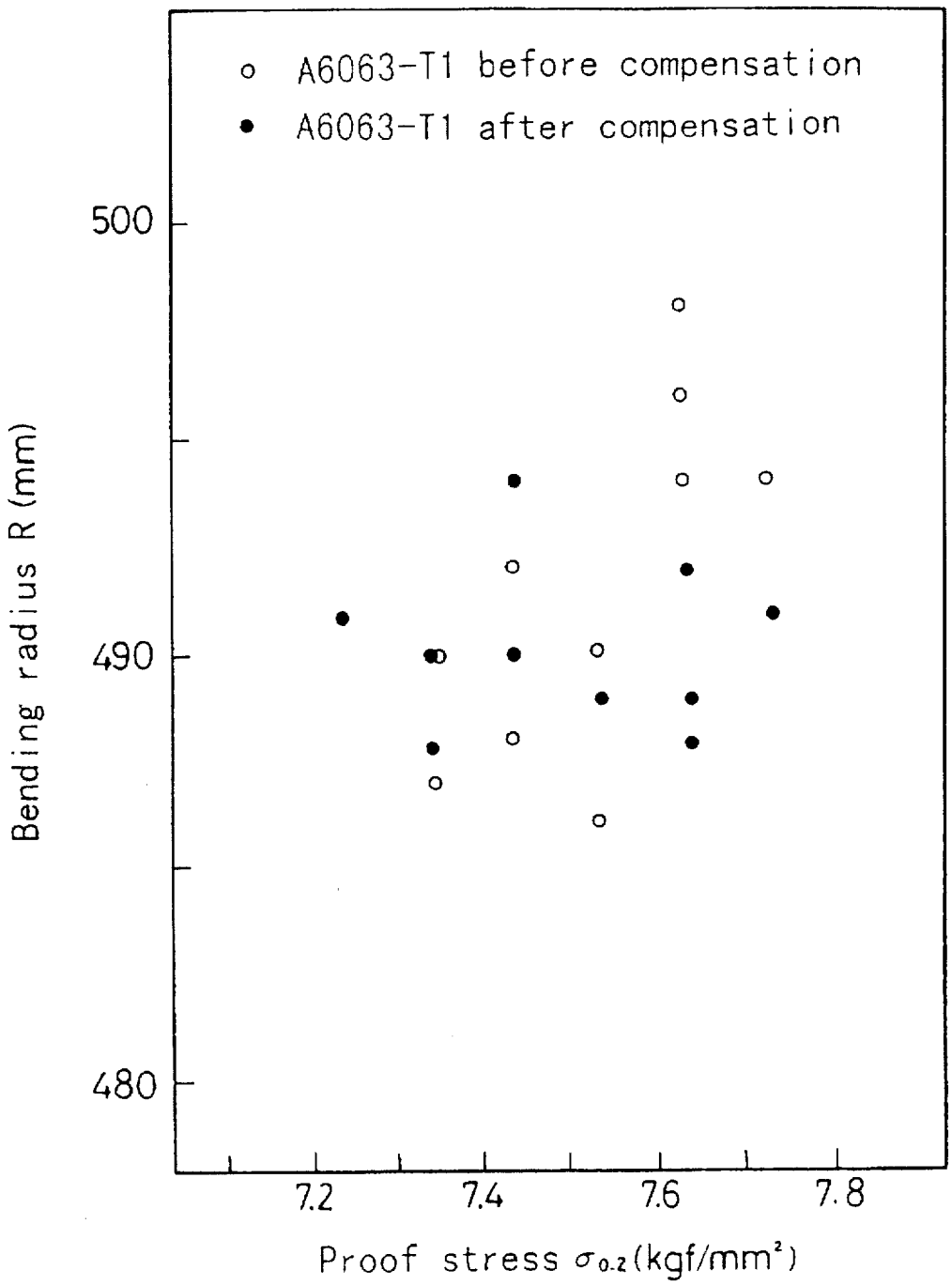
FIG. 4 is a graph showing the relationship between proof stress and bending radius before and after compensation in a case of bending process of a material of A6063-T1.

In the case of A6063-T1, as shown in FIG. 4, although the proof stress $\sigma_{0.2}$ disperses in the range of 7.2–7.7 kgf/mm$^2$ (71–76N/mm$^2$), the bending radius R is in the range of 488–494 mm. Accordingly, the dispersion is lowered approximately 50% compared with the one before compensation.

Figure 5:
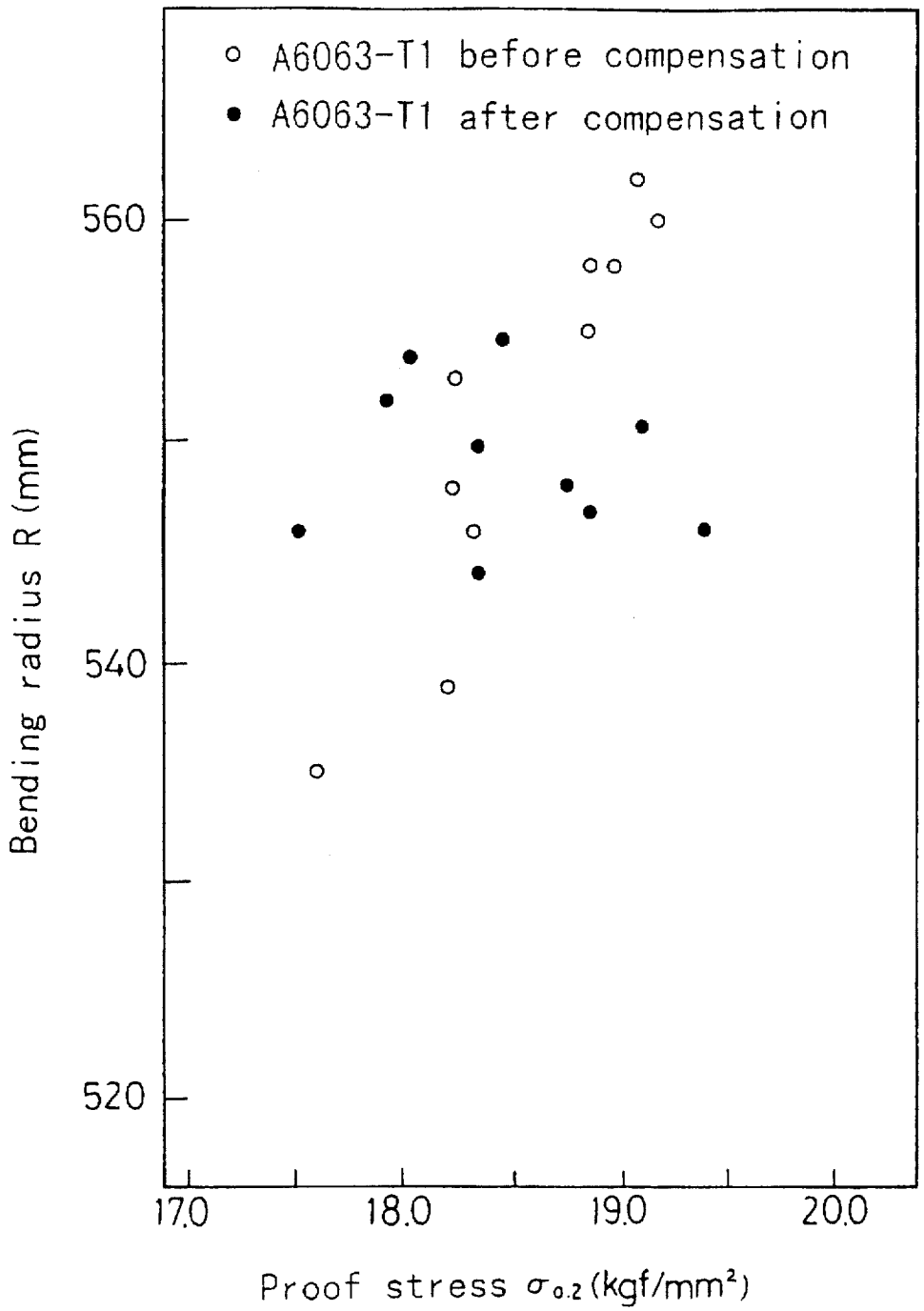
FIG. 5 is a graph showing the relationship between proof stress and bending radius before and after compensation in a case of bending process of a material of A6063-T5.

In the case of A6063-T5, as shown in FIG. 5, although the proof stress $\sigma_{0.2}$ disperses in the range of 17.5–19.5 kgf/mm$^2$ (172–191N/mm$^2$), the bending radius R is in the range of 544–555 mm. Accordingly, the dispersion is lowered approximately 60% compared with the one before compensation.

The present invention is not limited to the above-described embodiments but it may be varied in many ways. For example, in the above embodiments, the Rockwell hardness is used as the hardness, but the conversion equation for converting the value measured by a simple penetrometer into proof stress may be set and used. Alternately, another measured hardness can be converted into the Rockwell hardness and the conversion equation (6) may be used.

Thus, as described above, during the bending process for allowing springback, strength of material (proof stress) which affects the transformation and the result of bending is converted from the easily measured hardness, and the converted value is included in bending data, so that without deteriorating the work efficiency, the moving distance of the movable bending die for compensating springback can be found efficiently, and the bending accuracy can be improved.

Further, according to the one aspect of the invention that the formula of the Rockwell hardness and proof stress is combined with the formula of proof stress, geometrical coefficient and bending radius, prior to the bending process, materials to be processed are pre-tested, so that the appropriate moving distance of the movable bending die for compensating springback of aluminum alloy can be found, which is very effective in practice.

Furthermore, according to another aspect of the invention that the operating procedure is explained with the formula including coefficients of JIS A6063 as an aluminum alloy extruded shapes, bending of extruded shapes which are frequently utilized can be easily and efficiently performed.

While the invention has been shown and described with reference to the illustrated embodiments, it should be understood that various changes in form and details may be made without departing from the scope of the invention which is defined in the appended claims.

What is claimed is:

1. A method of bending extruded shapes using a movable bending die for controlling a bending radius in accordance with a moving distance, said method of bending extruded shapes comprising the steps of:

measuring a hardness of an extruded shaped to be processed;

converting the measured hardness into a proof stress;

determining a bending condition for compensating spring-back based on said proof stress; and bending said extruded shape to produce said bending angle, whereby said moving distance is determined based upon said bending condition, said extruded shaped is placed in said movable die and said movable die is accordingly moved said moving distance to produce said extruded shape having said bending radius.

2. A method of bending extruded shapes using a movable bending die for controlling a bending radius in accordance with a moving distance, said method of bending extruded shapes comprising the steps of:

measuring a hardness of an extruded shaped to be processed;

converting the measured hardness into a proof stress;

determining a bending condition for compensating spring-back based on said proof stress; and bending said extruded shape to produce said bending angle, whereby said moving distance is determined based upon said bending condition, said extruded shaped is placed in said movable die and said movable die is accordingly moved said moving distance to produce said extruded shape having said bending radius, wherein a correction coefficient C showing a ratio of a practical value of said moving distance and a theoretical value of said moving distance in a case of no spring-back occurring is defined by a function of Young's modulus E, geometrical coefficient Z, Bending radius R and proof stress $\sigma_{0.2}$ for said extruded shape to be processed;

said correction coefficient C is obtained by measuring said hardness into said proof stress and substituting said proof stress and a predetermined bending radius R into said function; and said practical value of said moving distance of said movable bending die is determined.

3. A method of bending extruded shapes using a movable bending die for controlling a bending radius in accordance with a moving distance, said method of bending extruded shapes comprising the steps of:

measuring a hardness of an extruded shaped to be processed;

converting the measured hardness into a proof stress;

determining a bending condition for compensating spring-back based on said proof stress; and bending said extruded shape to produce said bending angle, whereby said moving distance is determined based upon said bending condition, said extruded shaped is placed in said movable die and said movable die is accordingly moved said moving distance to produce said extruded shape having said bending radius, wherein bending is performed by pushing an aluminum alloy extruded shape into a fixing die and said movable die;

said hardness H of said extruded shape to be measured is measured and converted into 0.2% proof stress $\sigma_{0.2}$ by a first equation of $$\sigma_{0.2}=g\times H+h$$

where g and h are constants;

a correction coefficient C showing a ratio of a practical value of said moving distance and a theoretical value of said moving distance is calculated from a second equation of $$C=(A\times(Z\times\sigma_{0.2})+0.3)\times10^{-3}\times R\times B$$

where;

A is a constant in a range of $(8–10)\times10^{-6}$;

B is a constant in a range of 3.0–3.6;

Z is an average value of moduli of a section on a tension side and compression side ($mm^3$);

$\sigma_{0.2}$: 0.2% proof stress in the tension test ($kgf/mm^2$);

R represents said bending radius (mm); and said practical value of said moving distance of said movable bending die is determined.

4. A method of bending extruded shapes according to claim 3, wherein said extruded shape to be processed is aluminum alloy extruded shapes; and when said first equation is used for determining said 0.2% proof stress ($kgf/mm^2$) from Rockwell F scale hardness, g=0.30 and h=−1.63.

* * * * *